US008390408B2

(12) United States Patent
Nawa

(10) Patent No.: US 8,390,408 B2
(45) Date of Patent: Mar. 5, 2013

(54) ELECTROMAGNETIC SWITCH INCORPORATING CONTACT DISPLACEMENT LIMITING MEMBERS FOR PREVENTING UNRELIABLE OPERATION CAUSED BY WEAR OF SWITCH CONTACTS

(75) Inventor: Yukio Nawa, Gifu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/428,696

(22) Filed: Mar. 23, 2012

(65) Prior Publication Data

US 2012/0242431 A1 Sep. 27, 2012

(30) Foreign Application Priority Data

Mar. 23, 2011 (JP) ..... 2011-063716

(51) Int. Cl.
*H01H 67/02* (2006.01)
*H01H 63/02* (2006.01)

(52) U.S. Cl. ..... 335/131; 335/132; 335/133

(58) Field of Classification Search ..... 335/126, 335/131–133
See application file for complete search history.

(56) References Cited

U.S. PATENT DOCUMENTS

| | | | | |
|---|---|---|---|---|
| 6,443,023 | B1 * | 9/2002 | Kajino et al. | 74/7 E |
| 7,034,643 | B1 * | 4/2006 | Kusumoto et al. | 335/126 |
| 7,772,944 | B2 * | 8/2010 | Kurasawa et al. | 335/126 |
| 7,982,564 | B2 * | 7/2011 | Farrar et al. | 335/126 |
| 2004/0032309 | A1 * | 2/2004 | Kajino et al. | 335/126 |
| 2009/0183595 | A1 | 7/2009 | Niimi | |
| 2010/0271155 | A1 * | 10/2010 | Kaneda et al. | 335/126 |

FOREIGN PATENT DOCUMENTS

| | | |
|---|---|---|
| JP | A-2009-033803 | 2/2009 |
| JP | A-2009-114950 | 5/2009 |
| JP | A-2009-191843 | 8/2009 |

* cited by examiner

*Primary Examiner* — Ramon Barrera
(74) *Attorney, Agent, or Firm* — Oliff & Berridge, PLC

(57) ABSTRACT

In an electromagnetic switch, current flow through a coil causes a plunger to be axially displaced by magnetic attraction, against a restoring force of a return spring, thereby axially displacing a movable contact against fixed contacts and so enabling current flow via the contacts. One or more contact displacement limiting members are disposed on the opposite side of the fixed contacts from the movable contact, for limiting the extent to which the movable contact can be axially displaced when the fixed contacts have become worn by repetitive switching operations. A condition in which the movable contact cannot be restored to a "contacts open" position is thereby prevented.

12 Claims, 7 Drawing Sheets

ELECTROMAGNETIC SWITCH INCORPORATING CONTACT DISPLACEMENT LIMITING MEMBERS FOR PREVENTING UNRELIABLE OPERATION CAUSED BY WEAR OF SWITCH CONTACTS

CROSS-REFERENCE TO RELATED APPLICATIONS

This application is based on and incorporates herein by reference Japanese Patent Application No. 2011-63716 filed on Mar. 23, 2011.

BACKGROUND OF THE INVENTION

1. Field of Application

The present invention relates to an electromagnetic switch to be connected in an electrical circuit, controllable for opening/closing switch contacts to interrupt/enable supplying of current by the electrical circuit to a load such as a DC motor.

2. Background Technology

An example of an electromagnetic switch is described in U.S. patent application publication No. 2009/0183595, referred to in the following as reference 1, with the switch being incorporated in a starter apparatus for the drive engine of a vehicle (where "vehicle" as used herein signifies an automotive vehicle, with "engine" signifying an internal combustion engine and "motor" signifying a DC electric motor). In that apparatus, a first solenoid actuates a pinion of a starter motor to become pressed against a ring gear of the vehicle engine. A second solenoid (of the electromagnetic switch) serves to open/close switch contacts, connected in a circuit which supplies current to the starter motor. The first solenoid and the second solenoid are controlled respectively independently. This enables the timings at which the pinion is actuated by the first solenoid and the timings at which current is supplied the starter motor by the action of the second solenoid to be respectively independently controlled. These timings can thus be optimally determined for the purposes of an idling stop system.

The function of an idling stop system installed in a vehicle are essentially as follows. When the vehicle becomes halted temporarily (e.g., at traffic lights or due to traffic congestion), the idling stop system automatically halts the supplying of fuel to the vehicle engine, stopping the engine. Thereafter when the vehicle driver performs some predetermined action which indicates that the vehicle is to be set in motion (e.g., releases the brake pedal, or shifts the automatic transmission to the drive range), the idling stop system automatically operates the starter apparatus to restart the engine.

Exhaust gas emissions can thereby be reduced and fuel consumption decreased, so that such idling stop systems have come into increasing use.

However, by comparison with a vehicle which does not incorporate such a system, an idling stop system has the disadvantage that the frequency of stopping/restarting the engine is increased considerably. Thus the frequency of using the starter apparatus is increased accordingly. When the starter apparatus of reference 1 is used with such an idling stop system, the frequency of opening/closing the switch contacts is increased by approximately a factor of 10, by comparison with a conventional system. Hence, the rate of wear of the switch contacts is increased accordingly, thereby substantially reducing the operating lifetime of the switch contacts.

This point will be described more specifically referring to FIG. 10, which is a cross-sectional view of the interior of a known type of electromagnetic switch. The configuration shown is basically identical to that of the electromagnetic switch 6 shown in FIGS. 1 and 2 of reference 1. In the electromagnetic switch 100 of FIG. 10, when a current is passed through a coil 110, a stationary iron core 120 becomes magnetized thereby pulling a plunger 130 along an axial direction. A pair of terminal bolts 150 and 160 are fixed in a plastic cover 140 (where "plastic" as used herein signifies polymer resin), and are respectively connected to stationary contacts 170 and 171.

The terminal bolts 150 and 160 consist of the B-terminal bolt 150, which is connected to the positive potential of the vehicle battery, and the M-terminal bolt 160 which is connected to the starter motor, i.e., is connected via an armature winding of the starter motor to the negative potential of the battery. The stationary contacts 170 and 171 are located within a contact chamber in the interior of the plastic cover 140, respectively attached (electrically connected) to the B-terminal bolt 150 and to the M-terminal bolt 160.

A movable contact 180 is located at the axially opposite side of the stationary contacts 170 and 171 from the plunger 130, and bears against an end face of the rod 190, which is fixedly attached at its opposite end to the plunger 130.

When current does not flow through the coil 110, the plunger 130 is urged axially rightward (as viewed in FIG. 10) by a return spring 210 which is located between the stationary iron core 120 and the plunger 130. In that condition, the movable contact 180 is held separated from the stationary contacts 170 and 171, so that the switch contacts are open. The terms "axial" and "axially", as used herein in describing internal components of an electromagnetic switch, are to be understood as referring a direction parallel to a central axis of the plunger (i.e., parallel to the displacement direction of the plunger) of the electromagnetic switch.

When current is passed through the coil 110 thereby magnetizing the stationary iron core 120, the plunger 130 becomes attracted towards the stationary iron core 120 and so displaces the rod 190 axially leftward, compressing the return spring 210. A contact press spring 200 is thereby enabled to urge the movable contact 180 into electrical contact with each of the stationary contacts 170 and 171, so that the switch contacts become closed.

Over a period of use in which a large number of on/off switching operations have been executed, one or both of the stationary contacts 170 and 171 may become completely worn. Here, the term "completely worn" as applied herein to a stationary contact signifies that a part of the stationary contact has become worn in an axial direction by an amount equal to its (original) thickness. In practice, the stationary contacts 170 and 171 do not become worn at identical rates, with the rate of wear of the positive-side terminal being greater than that of the negative-side terminal. This is illustrated in FIG. 11, in which the first stationary contact 170, attached to the B-terminal bolt 150, has become completely worn, whereas the second stationary contact 171 remains only partially worn. For similar reasons (also as illustrated) the face region of the movable contact 180 which comes into direct contact with the second stationary contact 171 will become worn at a greater rate than the face region which contacts the first stationary contact 170.

When the switch contacts are closed, with part of the first stationary contact 170 in a completely worn condition such as is shown in FIG. 11, an outer side portion of the movable contact 180 (e.g., an upper side portion, as viewed in FIG. 11) may penetrate beyond the thickness of the first stationary contact 170, and thus may become tilted. In that condition, when the current flow through the coil 110 is then interrupted, an outer side portion of the movable contact 180 may become caught against the worn portion of the first stationary contact 170. When this occurs, in the worst case, the restoring forces applied by the return spring 210 may not be sufficient to return the movable contact 180 to the "contacts open" position. Thus the electromagnetic switch will be held in the "contacts closed" condition, supplying current continuously to the starter motor.

An additional danger is as follows. When current flow through the coil 110 is halted, the movable contact 180 may adhere to one or both of the contacts 170, 171 due to contact welding, and sufficient force must then be applied by the return spring 210 for overcoming such adherence. However at the stage when the first stationary contact 170 and/or second stationary contact 171 has become completely worn, the sizes, positions and shapes of areas of contact between these contacts and the movable contact 180 will have become substantially changed from original conditions of these. As a result of these changes, if contact welding occurs, the amount of force required to separate the movable contact 180 from the stationary contacts 170 and 171 may exceed the restoring force applied by the spring 210, so that the movable contact 180 will remain held at the "contacts closed" position.

SUMMARY

Hence it is desired to overcome the above problem, by providing an electromagnetic switch which can prevent a condition whereby, due to wear of stationary contacts of the electromagnetic switch, a movable contact of the electromagnetic switch cannot be reliably returned to a position for interrupting current flow via the stationary contacts and movable contact.

From a first aspect, the disclosure provides an electromagnetic switch comprising switch contacts which are connected in an electrical circuit, for enabling/interrupting a supply of current to an electrical load in accordance with the switch contacts being in an open/closed state, and a solenoid for operating the switch contacts. The solenoid comprises a coil, and a plunger formed of a magnetic material, with the plunger actuating the switch contacts to be closed or opened in accordance with whether a current is passed through the coil. The switch contacts consist of a pair of stationary contacts which are adapted to be respectively connected to a high-potential (positive-potential) side and a low-potential (negative-potential) side of the electrical circuit, and a movable contact which is actuated by the plunger for connecting/disconnecting the stationary contacts from one another.

The electromagnetic switch further comprises one or more contact displacement limiting members, formed of an electrically insulating material and located with axial-direction end faces disposed opposite contact-opposite side faces of the stationary contacts. Here "contact-opposite face" signifies a face which is on the opposite side of the stationary contact from the face that is contacted by the movable contact when the switch contacts are closed. The contact displacement limiting members serve to limit the extent of axial displacement of the movable contact, when one or both of the stationary contacts has become fully worn, i.e., when the movable contact has become exposed to one or more of the contact displacement limiting members.

Specifically, when one or both of the stationary contacts has become worn (due to repeated on/off switching operations) by an amount as great as its original thickness, the contact displacement limiting members serve to limit the extent to which the movable contact can be moved between the stationary contacts (beyond the contact-opposite faces of the stationary contacts) when the switch contacts are closed. It can thereby be ensured that the movable contact cannot become caught against the stationary contacts and so prevent the electromagnetic switch from being returned to the open state. The danger of a switch failure which causes current to be continuously supplied to the electrical load can thereby be avoided.

From a second aspect, such an electromagnetic switch is preferably configured with respective end faces of the contact displacement limiting members (with respect to the axial direction) in contact with the contact-opposite side faces of the stationary contacts. This serves to reliably ensure that the movable contact cannot move axially (between the stationary contacts) to a greater extent than the original thickness of the stationary contacts, even if one or both of the stationary contacts has become completely worn.

From a third aspect, the contact-opposite side faces of the stationary contacts may be formed with recesses (concave regions) which are configured to accommodate respective ones of the axial-direction end faces of the contact displacement limiting members. This enables the contact displacement limiting members to limit further displacement of the movable contact even before one or both of the stationary contacts has become completely worn. Thus, the contact displacement limiting members can restrict the extent of axial displacement of the movable contact such that neither of the stationary contacts can become completely worn, i.e., one or more of the contact displacement limiting members will become exposed to the movable contact before such a completely worn condition can be reached. The danger of the movable contact becoming attached to the stationary contacts due to contact welding, to such a degree that the movable contact cannot be returned to the "open contacts" position, can thereby be reliably prevented.

From a fourth aspect, with the movable contact being located at the axially opposite side of the stationary contacts from the plunger, and with the coil of the solenoid being wound upon a bobbin which is formed of a polymer resin, the contact displacement limiting members may be formed integrally with the bobbin.

This serves to reduce the number of component parts required for the electromagnetic switch, and also enables the work of assembling the electromagnetic switch to be simplified.

From a fifth aspect, when the contact displacement limiting members are to be integrally formed with the bobbin, the invention may be advantageously applied to an electromagnetic switch in which the solenoid includes an annular magnetic plate, forming part of a magnetic circuit and extending radially at right angles to the central axis of the plunger, disposed outside the circumferential periphery of the plunger. In that case the bobbin may be formed with first, second and third flange portions which are successively axially separated, each extending radially with respect to the central axis of the plunger, with the coil being supported between the first and second flange portions, the second flange portion being located adjacent to the plunger, and the annular magnetic plate being enclosed between the second and third flange portions. With this configuration, the contact displacement limiting members are preferably formed to protrude axially towards the stationary contacts, from a face of the third flange portion that is on an opposite side of the third flange portion from the magnetic plate.

From a sixth aspect, the coil may be wound on a bobbin formed of a polymer resin material, but with the contact displacement limiting members being formed separately from the bobbin, of a material having a higher resistance to effects of heat than the polymer resin material of the bobbin. For example the contact displacement limiting members may be formed of a thermoplastic polymer resin having exceptionally high resistance to effects of heat, or formed of a thermosetting polymer resin.

From a seventh aspect, when the contact displacement limiting members are to be formed separately from the bobbin, while the bobbin is to be formed with first, second and third flange portions as described for the fifth aspect of the invention above, the third flange portion is preferably formed with an annular boss which protrudes axially towards the stationary contacts and extends around the circumferential periphery of the plunger, separated from that periphery. With that configuration, the contact displacement limiting members are fixedly attached to a ring member (annular member), preferably by being formed integrally with the ring member. The ring member is configured to be attached to the bobbin by engaging with the annular boss of the third flange portion, thereby attaching the contact displacement limiting members to the bobbin.

With such an arrangement, the contact displacement limiting members are fixedly linked by the ring member and their relative circumferential positions thereby fixedly defined, and the contact displacement limiting members can be attached without requiring a number of additional components such as screws, etc. Hence the required number of components is minimized and the work of assembling the electromagnetic switch is simplified.

From an eighth aspect, all of the contact displacement limiting members may be located adjacent to and directly opposite the contact-opposite face of a specific one of the pair of stationary contacts, for the following reason. When the movable contact is repeatedly actuated to connect together and disconnect a pair of stationary contacts, to thereby establish/interrupt a flow of current via the contacts, it can be anticipated that one of the stationary contacts (specifically, the stationary contact which is connected to the positive voltage side of an external circuit) will become completely worn more rapidly than the other stationary contact.

Hence, even if the contact displacement limiting members are provided only for the stationary contact which becomes most rapidly worn, similar effects can be expected as for when contact displacement limiting members are disposed opposing the contact-opposite faces of both of the stationary contacts.

The invention can be advantageously applied to an electromagnetic switch for supplying current to a starter motor of a vehicle engine. However it will be understood that the invention would be equally applicable to various other applications in which an electromagnetic switch must repetitively interrupt/supply current to an electrical load with high reliability.

DESCRIPTION OF PREFERRED EMBODIMENTS

Figure 1:
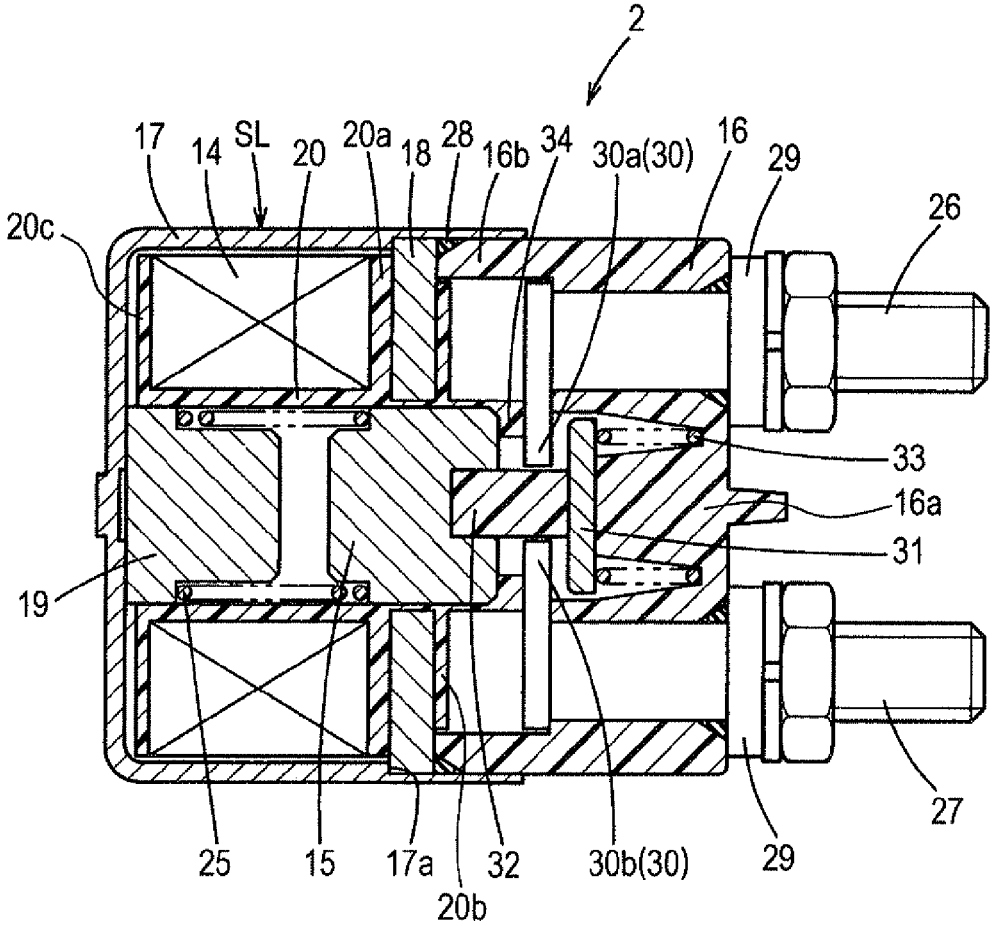
FIG. 1 is a cross-sectional view of a first embodiment of an electromagnetic switch.

An embodiment of an electromagnetic switch will be described, which is incorporated in a starter apparatus of the drive engine (internal combustion engine) of a motor vehicle. The embodiment, designated by reference numeral 2, will be described referring first to the circuit diagram of an engine starter apparatus 1 shown in FIG. 4.

As shown, the starter apparatus 1 includes a starter motor (referred to in the following simply as the motor) 3 for generating rotational force which is transmitted to an output shaft 4. A pinion 6 is mounted integrally with a clutch 5, on the circumference of the output shaft 4. A pinion drive solenoid 8 can be operated to actuate a shift lever 7, for moving the pinion 6 and clutch 5 in an axial direction away from the motor. The electromagnetic switch 2 selectively passes/interrupts a flow of current to the starter motor 3 from a battery 9. The starter motor 3 includes a field magnet 10 (e.g., a permanent magnet), an armature 12 having a commutator 11, and brushes 13 positioned at the periphery of the commutator 11. The starter motor 3 constitutes the electrical load of this embodiment.

Figure 4:
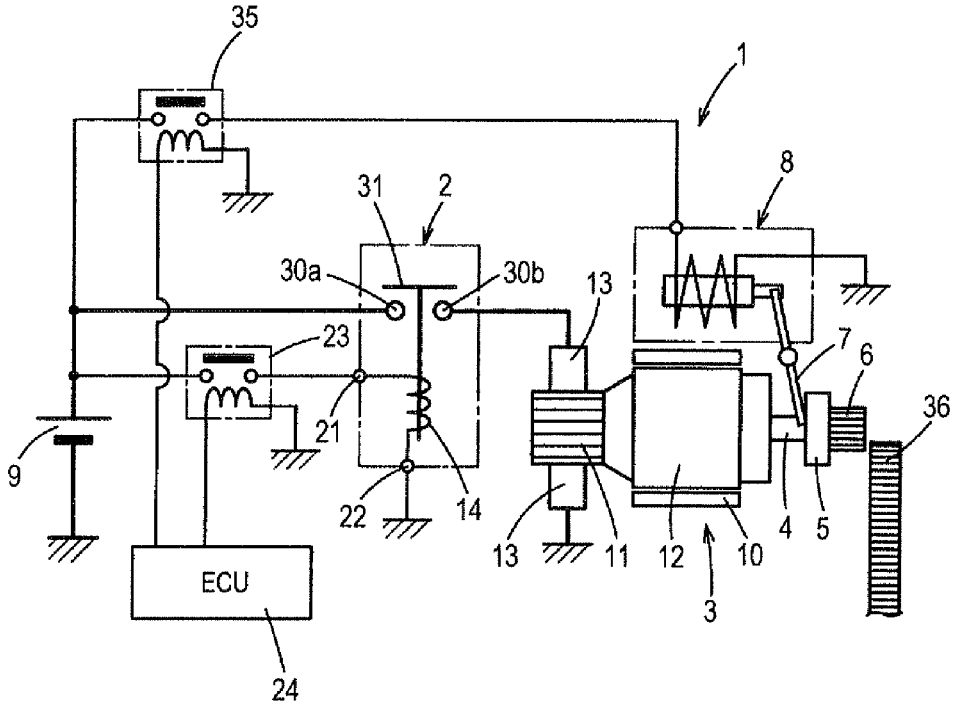
FIG. 4 shows a circuit diagram of an engine starter system for a vehicle engine.

As shown in the cross-sectional view of FIG. 1, the electromagnetic switch 2 includes a coil 14 and a stationary iron core 19 of a solenoid SL. Electromagnetic attraction produced by the solenoid SL when current is passed through the coil 14 acts on a plunger 15, formed of a magnetic material, displacing the plunger 15 axially towards the stationary iron core 19. The electromagnetic switch 2 further includes switch contacts 30*a*, 30*b*, and 31, connected in the starter motor supply circuit as shown in FIG. 4 and described hereinafter. The switch contacts are enclosed within a plastic cover 16, where "plastic" here signifies polymer resin.

The solenoid SL includes a solenoid case 17 which is formed for example by press molding, which encloses the coil 14 and is of cylindrical shape, closed at one end. The solenoid SL further includes a magnet plate 18 forming part of a magnetic circuit, which is of annular shape and extends radially with respect to a central axis of the plunger 15. The stationary iron core 19 is enclosed within the inner circumference of the coil 14. The plunger 15 is movable axially to/from from the vicinity of the stationary iron core 19 (i.e., moves leftward and rightward, as viewed in FIG. 1).

The solenoid case 17 of this embodiment is formed of polymer resin. As shown in FIG. 1, an axially inward portion of the solenoid case 17 (extending from the base end) has a smaller internal diameter than an axially outward portion (extending to the open end of the solenoid case 17). An circumferential step portion 17*a* is thus formed in the inner periphery of the solenoid case 17, as shown.

Figure 2:
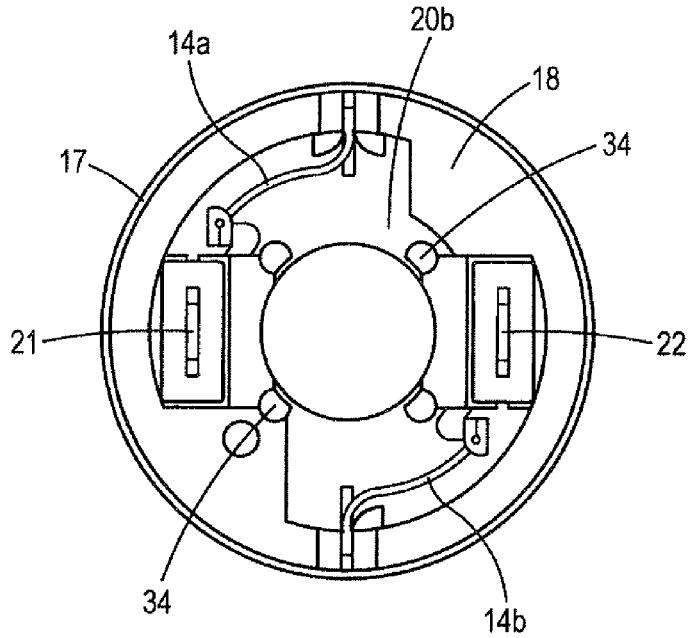
FIG. 2 is a plan view of the interior of the first embodiment, taken at right angles to the central axis of a solenoid of the switch, with a plastic cover removed.

The coil 14 is wound on a bobbin 20 formed of polymer resin, shaped with three flange portions 20*a*, 20*b* and 20*c*, with the flange portion 20*b* formed as an axially extended part of the bobbin 20 (i.e., of a part of the bobbin 20 which is closest to the plunger 15). The coil 14 is supported between the flange portions 20*a* and 20*c*, as shown in FIG. 1. The magnet plate 18 is retained between the flange portions 20*a* and 20*b*, having been set therein by insertion molding, being partially covered on one side by the flange portion 20*b* as shown in FIG. 2. The axial position of the magnet plate 18 is determined such that the magnet plate 18 abuts against the circumferential step portion 17*a* of the solenoid case 17, thereby fixing that axial position with respect to the inner end face of the solenoid case 17.

The form of the flange portion 20*b* is illustrated in the plan view of FIG. 2, which is taken at right angles to the central axis bobbin 20 and plunger 15 with the plastic cover 16 and its attached components removed. As shown in FIG. 2, coil terminals 14*a* and 14*b* of the coil 14 are respectively connected to the positive-side and negative-side terminals 21 and 22 (terminals 21, 22 being also shown in the circuit diagram of FIG. 4).

Figure 9:
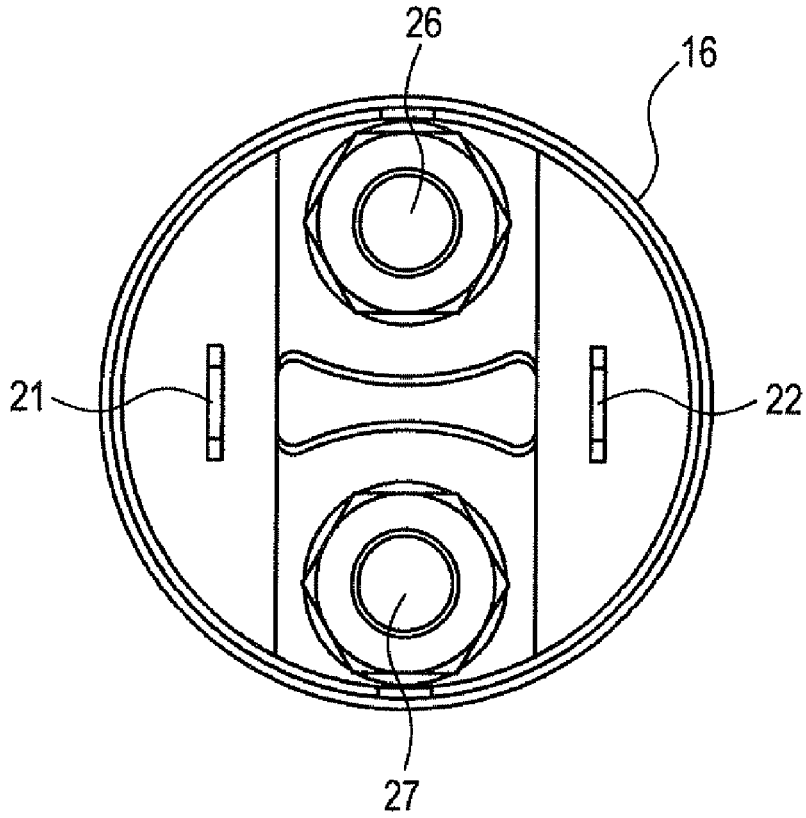
FIG. 9 is an axial plan view showing terminal bolts, and terminals for connection to a coil of a solenoid, in the interior of a plastic cover.
Figure 10:
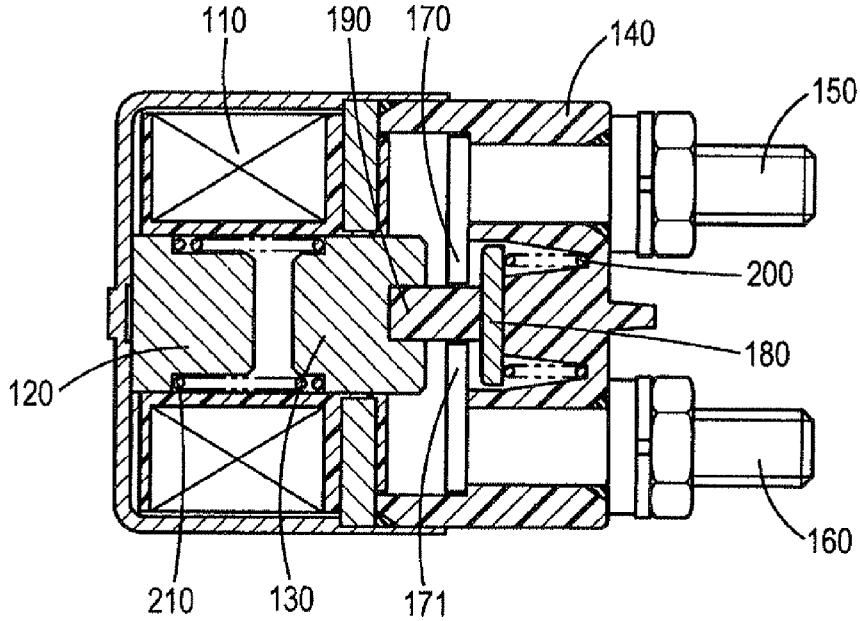
FIG. 10 is a cross-sectional view of a prior art example of an electromagnetic switch.
Figure 11:
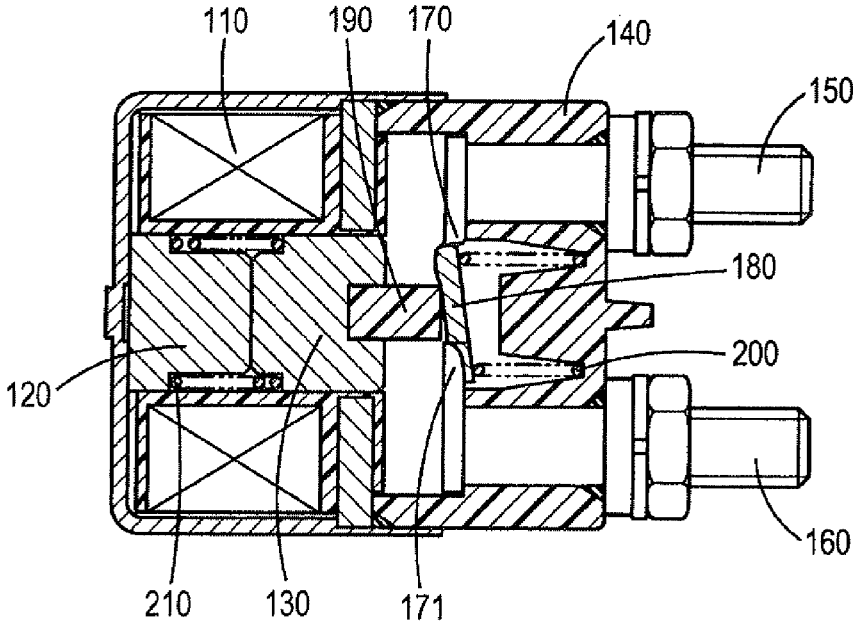
FIG. 11 is a cross-sectional view corresponding to FIG. 10, illustrating a condition in which a stationary contact has become completely worn.

The positive-side terminal 21 and negative-side terminal 22 are retained in the flange portion 20*a*, e.g., by insertion molding, and extend axially to the exterior of the plastic cover 16. The position relationships between the terminal bolts 26, 27 and the positive-side terminal 21 and negative-side terminal 22, mounted in the plastic cover 16, are illustrated in the axial plan view of FIG. 9.

As shown in FIG. 4, an ISS (idling stop system) ECU (electronic control unit) 24, which controls an idling stop system of the vehicle, also controls a relay 23 for selectively connecting/disconnecting the positive-side terminal 21 to/from the positive terminal of the battery 9. The negative-side terminal 22 is connected to the circuit ground potential, i.e., is electrically connected to the negative terminal of the battery 9.

As shown in FIGS. 1 and 2, a set of four contact displacement limiting members 34 are formed integrally with the flange portion 20*a* of the bobbin 20.

The stationary iron core 19 is formed of a magnetic material such as iron, to be magnetized when a current is passed through the coil 14. The end of the stationary iron core 19 which is axially opposite the plunger 15 is fixedly attached to the inner face of the base end of the solenoid case 17.

A return spring 25 is installed between the stationary iron core 19 and the plunger 15. The plunger 15 is formed of a magnetic type of material such as iron, as for the stationary iron core 19, and is urged in an axial direction away from the stationary iron core 19 (i.e., rightward, as viewed in FIG. 1) by the return spring 25.

The plastic cover 16 has a base portion 16*a* (at the right-side end, as viewed in FIG. 1) in which terminal bolts 26 and 27 are fixedly attached, and a cylindrical portion 16*b* extending axially (i.e., leftward, as viewed in FIG. 1) from the base portion 16*a*. The cylindrical portion 16*b* of the cover 16 is inserted into (i.e., to engage closely within) the internal circumference of the aforementioned outer end portion (right-side portion as viewed in FIG. 1) of the solenoid case 17, positioned such as to abut against the face of the magnet plate 18 which is on the opposite side of the magnet plate 18 from the flange portion 20*a*. Although omitted from the drawings, the outer circumference of the cylindrical portion 16*b* is preferably formed with a stepped face, configured for engaging with a part of the external circumference of the solenoid case 17 such as to securely attach the plastic cover 16 to the solenoid case 17. A rubber O-ring 28 is disposed between the cylindrical portion 16*b* of the plastic cover 16, the solenoid case 17, and the magnet plate 18 as a seal for preventing ingress of moisture, etc., from the exterior.

The B-terminal bolt 26 is connected to the battery cable and hence to the positive terminal of the vehicle battery 9, while the M-terminal bolt 27 is attached to a motor lead of the starter motor 3. The B-terminal bolt 26 and M-terminal bolt 27 pass through respective through-holes extending axially in the base portion 16*a* of the plastic cover 16, and are fixedly attached to the plastic cover 16 via respective washers 29.

The motor lead (current supply lead) is connected to the positive-side one of the brushes 13, as shown in FIG. 4.

The stationary contacts 30 and the movable contact 31 are enclosed within a contact space formed in the interior of the plastic cover 16.

The stationary contacts 30 are integrally formed with the B-terminal bolt 26 and M-terminal bolt 27 respectively. However it would be equally possible to form the terminal bolts 26 and 27 separately from the stationary contacts 30, and to fixedly attach the stationary contacts 30 to the terminal bolts 26 and 27 by press-fitting or welding, etc. In that case, the stationary contacts 30 can be formed of a different type of metal than that of the terminal bolts 26 and 27. For example the stationary contacts 30 may be formed of a metal such as copper, having high electrical conductivity, while the M-terminal bolt 27 may be formed of a material having high mechanical strength such as steel.

As a further alternative, the stationary contacts 30 could be formed by copper-plating respective end faces of the terminal bolts 26 and 27, if these are formed of steel, thereby providing high electrical conductivity and high mechanical strength.

The rod 32 is attached at one end to the plunger 15, while the axially opposite end (right-side end, as viewed in FIG. 1) is held against a face of the movable contact 31. When the switch contacts are in the open state, the movable contact 31 is held pressed against the rod 32 by an urging force applied by the contact press spring 33. The rod 32 is formed of an electrically insulating material such as polymer resin, and is of elongated cylindrical shape. The rod is attached (e.g., by press-fitting) within a cavity formed in an end face of the plunger 15, at the opposite end of the plunger 15 from the stationary iron core 19.

The contact press spring 33 is designed to apply a lower level of initial spring force than the return spring 25, where "initial spring force" signifies an amount of reaction force developed by a spring when it begins to be depressed. Hence when no current is being passed through the coil 14 (the condition shown in FIG. 1) the movable contact 31 is held separated from the stationary contacts 30, abutting an internal face of the plastic cover 16, due to the urging force applied to the stationary iron core 19 by the return spring 25.

The contact displacement limiting members 34 will be described in the following. With the electromagnetic switch 2 of this embodiment, when one or both of the stationary contacts 30 becomes completely worn (as defined hereinabove) and current is passed through the coil 14, the contact displacement limiting members 34 prevent the movable contact 31 from moving axially (beyond the plane of the unworn contact faces of the fixed contacts 30) by a greater amount than the axial-direction thickness of the stationary contacts 30. With this embodiment, the contact displacement limiting members 34 are formed integrally with the bobbin 20, of polymer resin, i.e., of an electrically insulating material. Each of the contact displacement limiting members 34 is formed as a short rod, extending in the axial direction from the flange portion 20*a* of the bobbin 20. An axial-direction end face of each contact displacement limiting member 34 is located directly opposite and closely adjacent to (or abutting) the contact-opposite face of a stationary contact 30. The term "contact-opposite face" is used herein to designate the face of a stationary contact 30 which is on the opposite side of that contact from the face which is contacted by the movable contact 31.

With this embodiment, a small gap may exist between the axial-direction end face of each of the contact displacement limiting members 34 and the corresponding contact-opposite face of a stationary contact 30. The size of the gap will vary, depending upon positioning errors of parts, manufacturing variations in dimensions of parts, etc. However the maximum permissible size of the gap must not exceed the thickness of a stationary contact 30.

The operation during engine starting will be described in the following. The operation of the electromagnetic switch 2 and of the pinion drive solenoid 8 are controlled by the ISS (idling stop system) ECU (electronic control unit) 24 shown in FIG. 4. The ISS ECU 24 receives signals which control the engine operating condition and are produced by an engine ECU (not shown in the drawings), such as an engine rotation signal, etc. The ISS ECU 24 also receives a transmission shift range position signal, brake switch on/off signal, etc. Based on these received signals, the ISS ECU 24 judges whether conditions for halting the engine are satisfied, and if the conditions are satisfied, transmits an engine halt request signal to the engine ECU.

After the engine has been halted, the ISS ECU 24 judges whether the vehicle driver performs an operation predetermined as indicating an intention to set the vehicle in motion, e.g., releasing the brake pedal, or shifting the transmission to the drive range. When such an operation is detected, so that it is judged that an engine restart request has been made by the driver, the ISS ECU 24 transmits an engine restart command to the engine ECU, and also outputs switch-on signals for actuating the electromagnetic switch 2 and to the pinion drive solenoid 8.

An example of halting/restarting the engine by operation of the idling stop system will be described in the following. The case will be described in which an engine restart request is received by the ISS ECU 24 (i.e., a specific action by the driver is detected, as described above) after the idling stop system has performed an engine halt operation, but before the engine has completely ceased to rotate. Firstly, the ISS ECU 24 generates a switch-on signal for the pinion drive solenoid 8, i.e., outputs a drive current for actuating the relay 35 shown in FIG. 4, to thereby actuate the pinion drive solenoid 8. The pinion 6 is thereby pushed by the shift lever 7 axially outward from the starter motor 3. At that time, the engine ring gear 36 is still rotating, with the rotation speed decreasing. The pinion 6 thus engages with the ring gear 36, when the ring gear 36 has rotated to a position at which this becomes possible.

After a predetermined interval (e.g., 30 to 40 ms) following generation of the switch-on signal for the pinion drive solenoid 8, the ISS ECU 24 outputs a switch-on signal for the electromagnetic switch 2, i.e., actuates the relay 23. Current is thus supplied from the battery 9 via the positive-side terminal 21 to the coil 14. The stationary iron core 19 is thereby magnetized by the current flow through the coil 14, thus attracting the plunger 15 and so compressing the return spring 19. In that condition, the movable contact 31 is moved by the urging force of the contact press spring 33 into contact with each of the stationary contacts 30, so that the switch contacts become closed. Current thereby flows from the battery 9 to the starter motor 3, causing rotational force to be generated by the armature 12, which is transmitted to the output shaft 4, and hence via the clutch 5 to the pinion 6. Since at that time the pinion 6 is engaged with the ring gear 36, rotational force is applied to the ring gear 36, so that engine cranking is commenced.

Effects of First Embodiment

With the electromagnetic switch 2 described above, used in conjunction with an idling stop system of a vehicle, there is an increased rate of opening/closing operations of the switch contacts, by comparison with the case in which an idling stop system is not employed. There is thus a corresponding increase in the rate of wear of the switch contacts, and so there is a danger that one or both of the stationary contacts 30 may become completely worn (as defined hereinabove).

Figure 3:
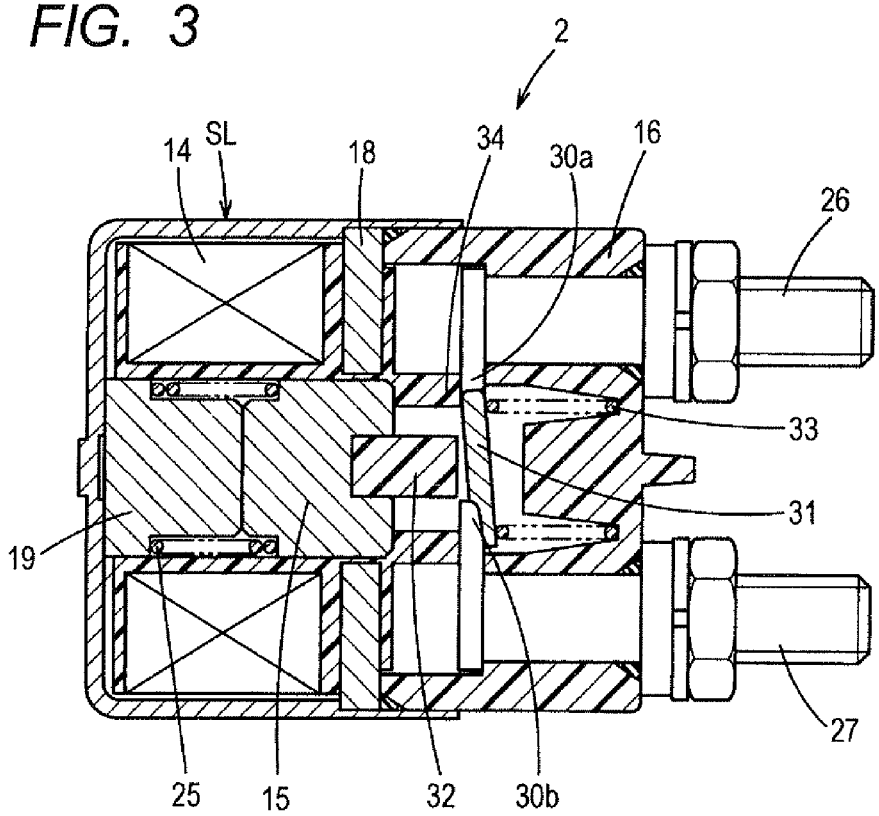
FIG. 3 is a cross-sectional view of the first embodiment, showing a condition in which one of a pair of stationary contacts has become completely worn.

However with the first embodiment, axial-direction end faces of the contact displacement limiting members 34 are disposed against or substantially close to the contact-opposite faces of the stationary contacts 30. Hence as shown in the example of FIG. 3, when current is passed through the coil 14, even if the first stationary contact 30*a* has become completely worn, the movable contact 31 is prevented by the contact displacement limiting members 34 from moving axially (i.e., in the contact-closing direction) to a significant extent beyond the stationary contacts 30. Alternatively stated, irrespective of the state of wear of the switch contacts, the movable contact 31 cannot be displaced axially (in the contact-closing direction) from the plane of the (unworn) contact face of a stationary contact 30 by substantially more than the original thickness of a stationary contact 30.

In the example of FIG. 3, the first stationary contact 30*a* is worn to a greater extent than the second stationary contact 30*b*. However it will be apparent that if the second stationary contact 30*b* should become completely worn before the first stationary contact 30*a*, or if both of the stationary contacts 30 become completely worn at the same time, the extent of displacement of the movable contact 31 in the contact-closing direction will be limited by the contact displacement limiting members 34 similarly as for the example of FIG. 3.

It can thereby be ensured that even if one or both of the stationary contacts 30 becomes completely worn, there is no danger that the movable contact 31 may become caught against a part of a stationary contacts 30, and thus become unable to be returned to the switch-off position, so that current would flow continuously to the starter motor 3 via the stationary contacts 30 and movable contact 31. The embodiment thus provides enhanced safety.

Second Embodiment

Figure 5:
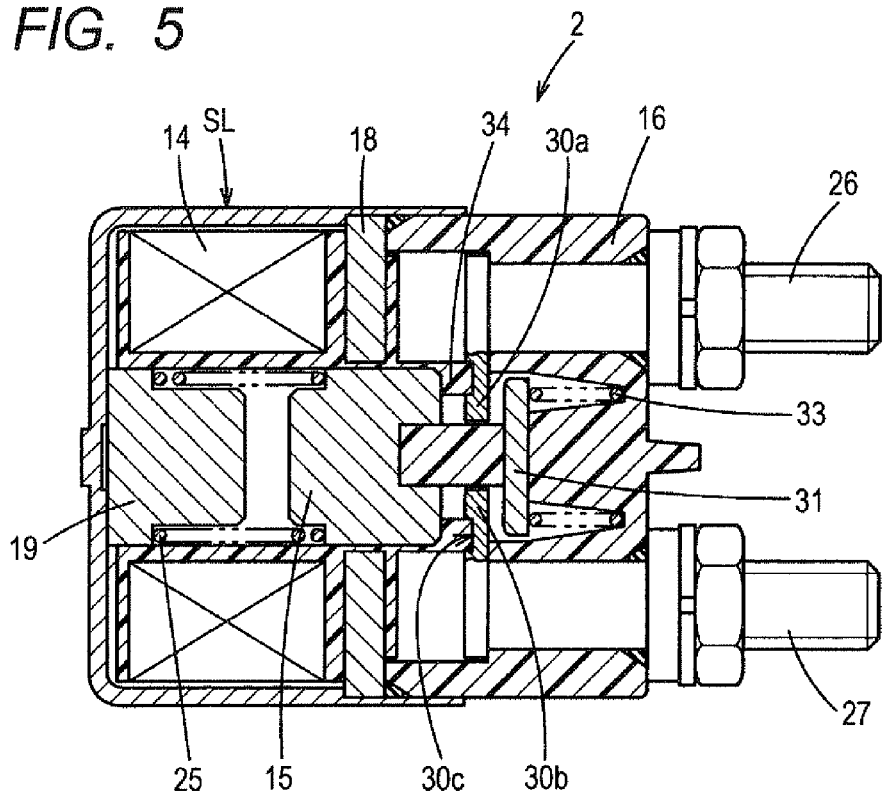
FIG. 5 is a cross-sectional view of a second embodiment of an electromagnetic switch.
Figure 6:
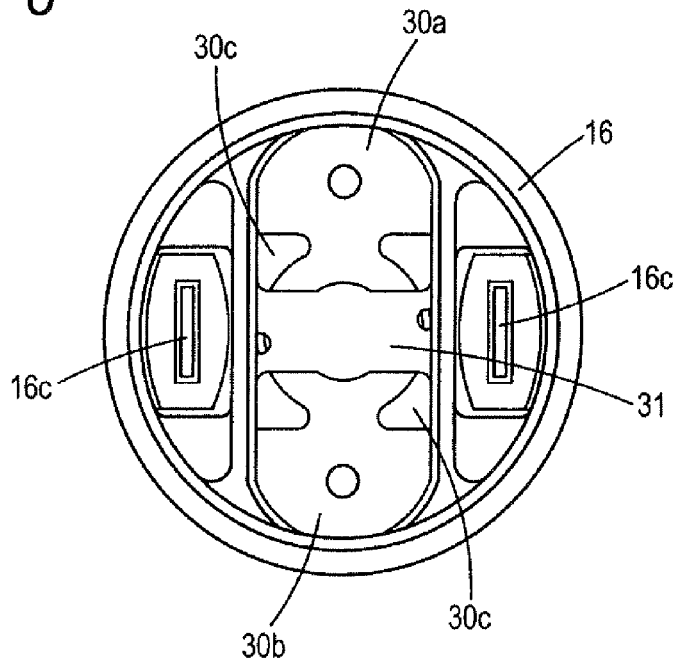
FIG. 6 is a plan view of the interior of the second embodiment, taken at right angles to the central axis of a solenoid of the switch, with a plastic cover removed.

A second embodiment of an electromagnetic switch will be described referring to the cross-sectional view of FIG. 5 and to FIG. 6, which is an axial-direction plan view of the interior of the plastic cover 16. Only the features which are different between the first and second embodiments will be described. With the second embodiment, four recesses (concave regions) 30*c* are formed in the contact-opposite faces of the first stationary contact 30*a* and the second stationary contact 30*b*, at respective positions corresponding to the four contact displacement limiting members 34. Each recess 30*c* is formed such that the corresponding contact displacement limiting member 34 can enter therein, by penetrating along an axial direction. Preferably, the recesses 30*c* are positioned such that the tip face of each contact displacement limiting member 34 is in contact with the inner (base) face of the corresponding 30*c*. Also as shown in FIG. 6, a part of the plastic cover 16 is formed with two slit-shaped apertures 16*c*, respectively located on opposing sides of the movable contact 31. The positive-side terminal 21 and negative-side terminal 22 pass through to the exterior of the plastic cover 16 via respective one of the apertures 16*c*.

With this embodiment, it will be understood that the axial-direction end face of a contact displacement limiting member 34 will become exposed (and will hence limit further axial displacement of the movable contact 31) before the corresponding stationary contact 30 has become completely worn, since each contact displacement limiting member 34 is partially embedded within a stationary contacts 30, in the thickness direction. Specifically, designating the thickness of a stationary contacts 30 as t and the depth of a recess 30*c* as d, the axial-direction end face of a contact displacement limiting member 34 will become exposed when the extent of (axial direction) wear of the corresponding stationary contacts 30 has become (t−d). Thus it can be ensured that neither of the stationary contacts 30 can become completely worn, since one or more of the contact displacement limiting members 34 will become exposed to the movable contact 31 before such a completely worn condition is reached.

In the example of FIG. 3, the first stationary contact 30*a* has become completely worn. As a result, in the prior art, the positions, shapes and sizes of the areas of contact between the stationary contacts 30 and the contact press spring 33 might become such that if contact welding occurs between these, the force applied by the return spring 25 might not be sufficient to return the movable contact 31 to the "contacts-open" condition. However by providing the contact displacement limiting members 34 in combination with the recesses 35*c* of the second embodiment, it can be ensured that the positions, shapes and sizes of the areas of contact will not change substantially over the usable life of the electromagnetic switch 2, since neither of the stationary contacts 30 can become completely worn. It can thus be reliably ensured that sufficient restoring force will always be applied by the return spring 25 to overcome adherence due to contact welding.

Third Embodiment

Figure 7:
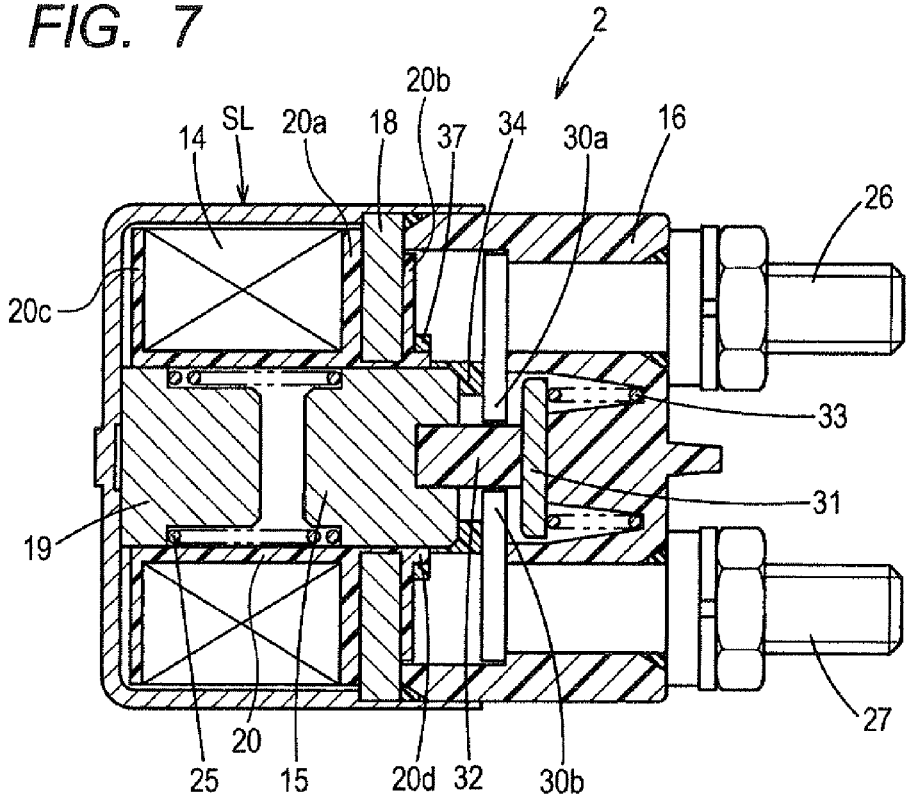
FIG. 7 is a cross-sectional view of a third embodiment of an electromagnetic switch.

With the first embodiment, the contact displacement limiting members 34 are formed integrally with the bobbin 20 on which the coil 14 is wound. With a third embodiment, as shown in the cross-sectional view of FIG. 7, the contact displacement limiting members 34 and the bobbin 20 are formed respectively separately. Specifically, as shown in FIG. 7 and in the plan view of FIG. 8 which illustrates the interior of the solenoid case 17 of the third embodiment, the inner circumference of the flange portion 20*b* of the bobbin 20 is formed with an annular boss (annular convex portion) 20*d*, extending axially towards the stationary contacts. The annular boss 20*d* is disposed around, but separated from, the circumferential perimeter of the plunger 15.

Figure 8:
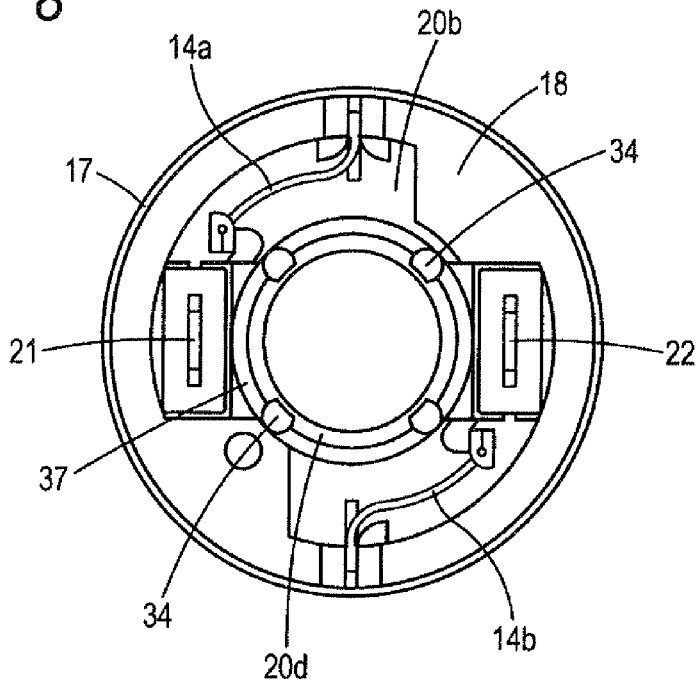
FIG. 8 is a plan view of the interior of the third embodiment, taken at right angles to the central axis of a solenoid of the switch, with a plastic cover removed.

As for the first embodiment, four contact displacement limiting members 34 are provided, located circumferentially with respect to the plunger 15 as shown in FIG. 8. However with this embodiment, the contact displacement limiting members 34 are formed separately from the bobbin 20, being formed integrally with (and thereby linked by) a ring member 37, i.e., with the contact displacement limiting members 34 each in the form of a short elongated rod which protrudes axially from the ring member 37 towards the stationary contacts 30*a*, 30*b*. The ring member 37 is configured with an inner circumferential periphery which engages with the outer circumferential periphery of the annular boss 20*d*, thereby attaching the contact displacement limiting members 34 with respect to the bobbin 20.

It should be noted that it is not essential to provide the annular boss 20*d* of this embodiment, and it would be equally possible to replace this with a circumferential array of segments (formed integrally with the bobbin 20), disposed at regular angular spacings, each extending axially from the flange portion 20*b* of the bobbin 20 towards the stationary contacts 30*a*, 30*b*. In that case, the inner circumferential periphery of the ring member 37 would engage with the circumferential outer periphery of the array of segments, providing a similar effect to that described for the case of the ring member 37.

With the third embodiment, since the contact displacement limiting members 34 are formed separately from the bobbin 20, the contact displacement limiting members 34 can be formed of a material which is more strongly resistant to heat than the plastic (polymer resin) used to form the bobbin 20. Specifically, the stationary contacts 30 may be formed of thermoplastic polymer resin having an especially high resistance to effects of heat, or from thermosetting polymer resin. For example, the bobbin 20 may be formed of polyamide resin combined with glass fiber, while the contact displacement limiting members 34 may be formed of aromatic polyamide resin or phenolic resin, etc., which have a high resistance to heat. In that case, even when the electromagnetic switch 2 is operated with a high level of current flowing between the stationary contacts 30 and the movable contact 31 in the "contacts closed" condition, so that a large amount of heat may be generated, a sufficient degree of heat withstanding capability can be ensured for the contact displacement limiting members 34.

Fourth Embodiment

With the first to third embodiments described above, respective pairs of contact displacement limiting members 34 are provided for (positioned adjacent to) the first stationary contact 30*a* and the second stationary contact 30*b*. However there may be restrictions upon the locations at which the contact displacement limiting members 34 can be disposed, depending upon the shape of the plastic cover 16. For example, the plastic cover 16 might be configured such that the positive-side terminal 21 and negative-side terminal 22 are led out together (pass out to the exterior of the plastic cover 16 along an axial direction) at radial positions which are close to the M-terminal bolt 27. With such a configuration, it may not be practicable to locate contact displacement limiting members 34 at positions axially opposite the second stationary contact 30*b*, which is attached to the M-terminal bolt 27.

In such a case, it would be possible to obtain satisfactory results even if contact displacement limiting members 34 are provided only at positions corresponding to (i.e., directly opposite a contact-opposite face of) the first stationary contact 30*a*, which is attached to the B-terminal bolt 26. As described above, it can be expected that the positive-potential stationary contact (stationary contact 30*a*) will wear at a more rapid rate than the negative-potential stationary contact (stationary contact 30*b*). Hence if the first stationary contact 30*a* becomes completely worn, even if contact displacement limiting members 34 are provided only at positions corresponding to the first stationary contact 30*a*, it can be ensured that further axial displacement of the movable contact 31 (to a greater extent than the thickness of stationary contacts 30, as described above) can be prevented. The advantages described for the first embodiment would thus be substantially obtained.

The fourth embodiment is not limited in application to the case whereby the contact displacement limiting members 34 are confined to positions corresponding to the first stationary contact 30*a* (positive-potential contact). It is possible that the electromagnetic switch 2 might be designed such that the second stationary contact 30*b* (negative-potential contact) will become completely worn before the first stationary contact 30*a*. In that case, it would be possible to modify the configuration of the fourth embodiment such that the positive-side terminal 21 and negative-side terminal 22 are led out together at radial positions close to first stationary contact 30*a*. This would enable the contact displacement limiting members 34 to be located only at positions corresponding to the second stationary contact 30*b*.

Alternative Embodiments

With each of the above embodiments, the electromagnetic switch 2 is suitable for use in a starter apparatus of the form shown in FIG. 4, in which the electromagnetic switch 2 and pinion drive solenoid 8 are separate from one another. However it would be equally possible to configure such an electromagnetic switch together with a pinion drive solenoid, in a combined unitary construction (e.g., enabling the switch solenoid and pinion drive solenoid to use a single stationary iron core in common) as for the apparatus described in reference 1 above.

Furthermore with the above embodiments, the electromagnetic switch 2 is of normally-open type, i.e., the switch contacts are in the open state when no current is passed through the coil 14. However the invention would be equally applicable to a normally-closed type of electromagnetic switch, in which the switch contacts remain closed when no current is being passed through the coil 14.

Furthermore with the first embodiment, the movable contact 31 is disposed on the opposite side of the stationary contacts 30 from the plunger. However the invention would be equally applicable to a type of electromagnetic switch which is described for example in Japanese patent publication No. 2009-114950. With that electromagnetic switch, the movable contact is disposed at the same side of the stationary contacts as the plunger, as shown in FIG. 1 of that patent. The movable contact is mounted on a plunger shaft, while being electrically insulated from the shaft by an insulator.

Furthermore with an electromagnetic switch configuration described in Japanese patent publication No. 2009-33803, as shown in FIG. 1 of that document, a metal terminal which is connected to the lead wire (pigtail) of the positive-side brush serves as a motor-side stationary contact of the electromagnetic switch (corresponding to the second stationary contact 30*b* of the embodiments of the present invention). Such a configuration would enable the M terminal bolt 27 of the first embodiment to be omitted.

The first embodiment described above is applied to a starter motor for starting the engine which drives a vehicle. However the invention could be equally applied to starter motors of other types of engine, such as aircraft engines.

Furthermore the first embodiment is described as being applied to an electromagnetic switch connected to an electrical load consisting of a starter motor 3. However the invention is not limited to this, and is applicable in general to an electromagnetic switch which is operated by enabling/interrupting current flow through an excitation coil (solenoid coil).

In the appended claims, as in the above description, the terms "axial" and "axially" are to be understood as signifying a direction parallel to the central axis of the plunger of an electromagnetic switch, i.e., parallel to the displacement direction of the plunger.

What is claimed is:

1. An electromagnetic switch, comprising:

switch contacts connected in an electrical circuit, said electrical circuit configured to supply current to an electrical load when said switch contacts are in a closed state, and a solenoid comprising a coil and a plunger, said plunger configured to be drawn along an axial direction into said coil by a magnetic force produced by passing a current through said coil, said switch contacts comprising a movable contact, a first stationary contact and a second stationary contact, said movable contact configured to be axially displaced by said plunger when said current magnetic force is produced, from a first axial position wherein said movable contact is separated from each of said first stationary contacts to a second axial position wherein said movable contact is held in contact with each of said stationary contacts to thereby establish said closed state, wherein:

said electromagnetic switch comprises one or more contact displacement limiting members having electrical insulation properties, each of said contact displacement limiting members disposed directly opposite a contact-opposite side face of one of said stationary contacts, said contact-opposite face being located on an opposite side of said stationary contact from a contact face thereof, and said contact face being contacted by said movable contact when said closed condition is established, said contact displacement limiting members serve to limit an extent of said axial-direction displacement of said movable contact, under a condition whereby a degree of wear of at least one of said stationary contacts has caused axial-direction end faces of said contact displacement limiting members to become exposed to said movable contact, said axial-direction end faces of said contact displacement limiting members are disposed in contact with said contact-opposite side faces of said stationary contact, and said contact-opposite side faces are formed with recesses configured to accommodate respective ones of said axial-direction end faces of said contact displacement limiting members.

2. An electromagnetic switch as claimed in claim 1, wherein said electrical load comprises a starter motor for starting an engine of a vehicle.

3. An electromagnetic switch as comprising:

switch contacts connected in an electrical circuit, said electrical circuit configured to supply current to an electrical load when said switch contacts are in a closed state, and a solenoid comprising a coil and a plunger, said plunger configured to be drawn along an axial direction into said coil by a magnetic force produced by passing a current through said coil, said switch contacts comprising a movable contact, a first stationary contact and a second stationary contact, said movable contact configured to be axially displaced by said plunger when said current magnetic force is produced, from a first axial position wherein said movable contact is separated from each of said first stationary contacts to a second axial position wherein said movable contact is held in contact with each of said stationary contacts to thereby establish said closed state, wherein:

said electromagnetic switch comprises one or more contact displacement limiting members having electrical insulation properties, each of said contact displacement limiting members disposed directly opposite a contact-opposite side face of one of said stationary contacts, said contact-opposite face being located on an opposite side of said stationary contact from a contact face thereof, and said contact face being contacted by said movable contact when said closed condition is established, said contact displacement limiting members serve to limit an extent of said axial-direction displacement of said movable contact, under a condition whereby a degree of wear of at least one of said stationary contacts has caused axial-direction end faces of said contact displacement limiting members to become exposed to said movable contact, said movable contact is disposed on an axially opposite side of said stationary contacts from said plunger, and said coil is wound upon a bobbin formed of a polymer resin material, and said contact displacement limiting members are respectively formed integrally with a part of said bobbin.

4. An electromagnetic switch as claimed in claim 3, wherein said solenoid comprises an annular magnetic plate forming part of a magnetic circuit, extending radially at right angles to a central axis of said plunger;

wherein said bobbin comprises a first flange portion, a second flange portion and a third flange portion, successively axially separated, said coil being supported between said first and second flange portions, said second flange portion being located at a closest end of said coil to said plunger, and said annular magnetic plate being enclosed between said second and third flange portions, and wherein said contact displacement limiting members comprise integrally formed portions of said bobbin, respectively protruding axially towards said stationary contacts from a face of said third flange portion, said face being on an opposite side of said third flange portion from said magnetic plate.

5. An electromagnetic switch as claimed in claim 4, wherein said contact displacement limiting members are disposed circumferentially with respect to said central axis of the plunger.

6. An electromagnetic switch comprising:

switch contacts connected in an electrical circuit, said electrical circuit configured to supply current to an electrical load when said switch contacts are in a closed state, and a solenoid comprising a coil and a plunger, said plunger configured to be drawn along an axial direction into said coil by a magnetic force produced by passing a current through said coil, said switch contacts comprising a movable contact, a first stationary contact and a second stationary contact, said movable contact configured to be axially displaced by said plunger when said current magnetic force is produced, from a first axial position wherein said movable contact is separated from each of said first stationary contacts to a second axial position wherein said movable contact is held in contact with each of said stationary contacts to thereby establish said closed state, wherein:

said electromagnetic switch comprises one or more contact displacement limiting members having electrical insulation properties, each of said contact displacement limiting members disposed directly opposite a contact-opposite side face of one of said stationary contacts, said contact-opposite face being located on an opposite side of said stationary contact from a contact face thereof, and said contact face being contacted by said movable contact when said closed condition is established, said contact displacement limiting members serve to limit an extent of said axial-direction displacement of said movable contact, under a condition whereby a degree of wear of at least one of said stationary contacts has caused axial-direction end faces of said contact displacement limiting members to become exposed to said movable contact, said coil is wound on a bobbin formed of a polymer resin, and said one or more contact displacement limiting members are formed separately from said bobbin, of a material having a higher resistance to effects of heat than said polymer resin of said bobbin.

7. An electromagnetic switch as claimed in claim 6, wherein said contact displacement limiting members are formed of a thermoplastic polymer resin having a higher resistance to effects of heat than said polymer resin of said bobbin, or are formed of a thermosetting polymer resin.

8. An electromagnetic switch as claimed in claim 6, wherein said solenoid comprises an annular magnetic plate forming part of a magnetic circuit, said magnetic plate extending radially at right angles to a central axis of said plunger;

wherein said bobbin comprises a first flange portion, a second flange portion and a third flange portion, successively axially separated, each extending radially with respect to a central axis of said plunger, said coil being supported between said first and second flange portions, said second flange portion being located at a closest end of said coil to said plunger, and said annular magnetic plate being enclosed between said second and third flange portions, said third flange portion being formed with a coaxial annular boss protruding axially towards said stationary contacts and surrounding a circumferential periphery of said plunger, spaced apart from said circumferential periphery, wherein said electromagnetic switch comprises a ring member configured to engage with said annular boss;

and wherein said contact displacement limiting members comprise a plurality of contact displacement limiting members disposed circumferentially with respect to said plunger and adjacent to said plunger, each of said contact displacement limiting members being axially elongated, having one end thereof disposed opposite said stationary contacts and an opposite end thereof fixedly attached to said ring member.

9. An electromagnetic switch as claimed in claim 8, wherein said contact displacement limiting members are formed integrally with said ring member.

10. An electromagnetic switch as claimed in claim 6, wherein said solenoid comprises an annular magnetic plate forming part of a magnetic circuit, extending radially at right angles to said common axis;

wherein said bobbin comprises a first flange portion, a second flange portion and a third flange portion, successively separated along said axial direction, each extending radially with respect to said a central axis of said plunger, said coil being supported between said first and second flange portions, said second flange portion being located at an end of said coil adjacent to said plunger, and said annular magnetic plate being enclosed between said second and third flange portions, with a face of said third flange on an opposite side from said magnetic plate being formed with a circumferential plurality of axially protruding segments, said segments disposed at regular angular spacings and surrounding an circumferential periphery of said plunger, wherein said electromagnetic switch comprises a ring member configured to engage with a circumferential periphery of said plurality of segments;

and wherein contact displacement limiting members comprise a plurality of contact displacement limiting members disposed adjacent to said circumferential periphery of said plunger, each of said contact displacement limiting members being axially elongated, having one end thereof disposed opposite said stationary contacts and an opposite end thereof fixedly attached to said ring member

11. An electromagnetic switch as claimed in claim 10, wherein said contact displacement limiting members are formed integrally with said ring member.

12. An electromagnetic switch comprising:

switch contacts connected in an electrical circuit, said electrical circuit configured to supply current to an electrical load when said switch contacts are in a closed state, and a solenoid comprising a coil and a plunger, said plunger configured to be drawn along an axial direction into said coil by a magnetic force produced by passing a current through said coil, said switch contacts comprising a movable contact, a first stationary contact and a second stationary contact, said movable contact configured to be axially displaced by said plunger when said current magnetic force is produced, from a first axial position wherein said movable contact is separated from each of said first stationary contacts to a second axial position wherein said movable contact is held in contact with each of said stationary contacts to thereby establish said closed state, wherein:

said electromagnetic switch comprises one or more contact displacement limiting members having electrical insulation properties, each of said contact displacement limiting members disposed directly opposite a contact-opposite side face of one of said stationary contacts, said contact-opposite face being located on an opposite side of said stationary contact from a contact face thereof, and said contact face being contacted by said movable contact when said closed condition is established, said contact displacement limiting members serve to limit an extent of said axial-direction displacement of said movable contact, under a condition whereby a degree of wear of at least one of said stationary contacts has caused axial-direction end faces of said contact displacement limiting members to become exposed to said movable contact, and all of said contact displacement limiting members are located adjacent to and directly opposite a specific one of said first stationary contact and said second stationary contact, said specific stationary contact being designed to reach a completely worn condition more rapidly than the other one of said first stationary contact and second stationary contact.

* * * * *